US006034639A

United States Patent [19]

Rawlins et al.

[11] Patent Number: 6,034,639

[45] Date of Patent: Mar. 7, 2000

[54] RETRACTABLE ANTENNA FOR PORTABLE COMMUNICATOR

[75] Inventors: Roger R. Rawlins, Mundelein; Brian L. Hahn, Buffalo Grove; Stephan D. Memmen, Lincolnshire, all of Ill.

[73] Assignee: T & M Antennas, Wheeling, Ill.

[21] Appl. No.: 08/995,489

[22] Filed: Dec. 22, 1997

[51] Int. Cl.[7] ..... H01Q 1/24

[52] U.S. Cl. ..... 343/702; 343/895; 343/901; 343/729

[58] Field of Search ..... 343/702, 900, 343/901, 906, 895, 725, 729; H01Q 1/24

[56] References Cited

U.S. PATENT DOCUMENTS

| | | | |
|---|---|---|---|
| 3,359,559 | 12/1967 | Guinn | 343/901 |
| 4,868,576 | 9/1989 | Johnson, Jr. | 343/702 |
| 4,920,354 | 4/1990 | Rauser et al. | 343/901 |
| 5,079,558 | 1/1992 | Koike | 343/702 |
| 5,177,492 | 1/1993 | Tomura et al. | 343/702 |
| 5,317,325 | 5/1994 | Bottomley | 343/702 |
| 5,389,938 | 2/1995 | Harrison | 343/702 |
| 5,479,178 | 12/1995 | Ha | 343/702 |
| 5,526,005 | 6/1996 | Koo | 343/702 |
| 5,594,457 | 1/1997 | Wingo | 343/702 |
| 5,594,459 | 1/1997 | Hirota | 343/702 |
| 5,650,789 | 7/1997 | Elliott et al. | 343/702 |
| 5,661,495 | 8/1997 | Saldell | 343/702 |
| 5,670,968 | 9/1997 | Inanaga et al. | 343/901 |
| 5,686,927 | 11/1997 | Simmons | 343/702 |
| 5,774,794 | 6/1998 | Kido | 343/702 |
| 5,900,846 | 5/1999 | Phelps et al. | 343/702 |

*Primary Examiner*—Hoanganh Le
*Attorney, Agent, or Firm*—Greer, Burns & Crain, Ltd.

[57] ABSTRACT

A retractable antenna for a portable communication device. The antenna retracts to a size within a portable communicator, such as a cell phone, which is smaller than the extended size of the antenna, while being flexible and otherwise suitable for the demanding environment of portable communicators. The antenna includes a contact sleeve which moves relative to an elongated conductor of the antenna, and also moves with the antenna while allowing the antenna to maintain electrical contact with another element in the antenna or the communicator. The sleeve may be connected to a helical conductor which forms part of the antenna and remains outside the housing of the portable communicator. Alternatively, the sleeve may be conductive on its inner and outer portions to move with and connect the elongated conductor to separate retracted and extended contact points within the portable communicator. Separate sections of elongated conductor may also extend separately from ends of the sleeve, with each being relatively movable. The antenna is accordingly adaptable to direct electrical contact, capacitive coupling, or a combination of both. The preferred antenna includes an elongated conductor having an enlarged contact which is spring loaded into the sleeve.

33 Claims, 6 Drawing Sheets

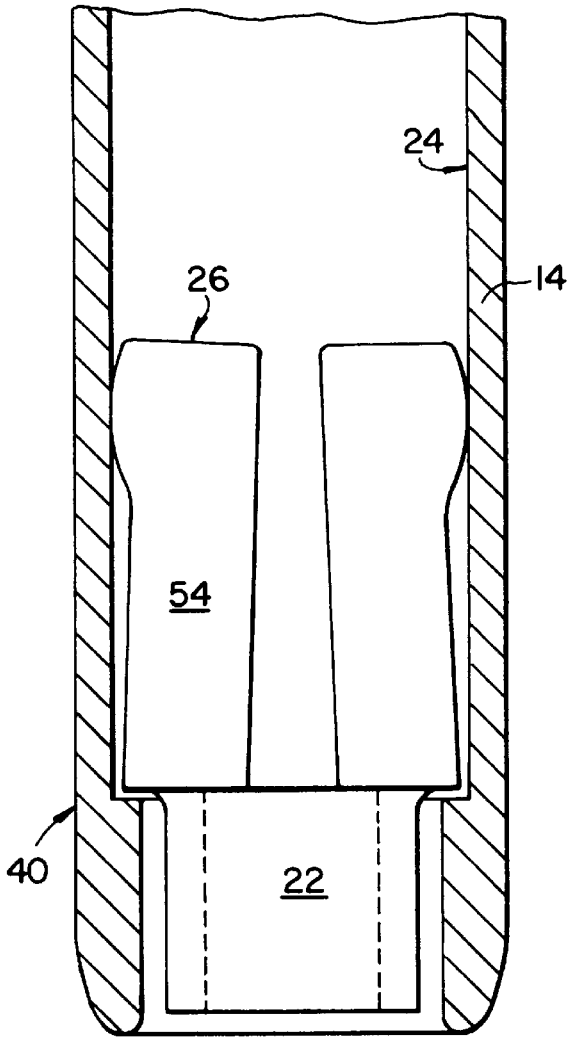
Fig. 2A
Fig. 2B
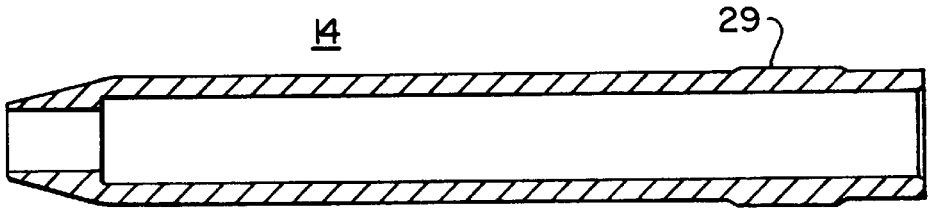
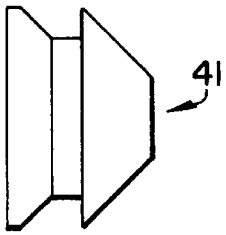
Fig. 2C

RETRACTABLE ANTENNA FOR PORTABLE COMMUNICATOR

The present invention generally concerns an antenna for a portable communicator that retracts to a length smaller than its extended length, while maintaining electrical connection to one or more contacts within the portable communicator. More specifically, the present invention concerns an antenna having an elongated electrical contact sleeve which is movable with the antenna and is movable relative to the antenna to permit an extended length greater than the stored length of the antenna.

BACKGROUND OF THE INVENTION

Usability of portable communicators, particularly cell phones, is greatly enhanced when size is reduced. Smaller packaged cell phones may be conveniently stored by a user in purses, briefcases, and more recently, even in shirt pockets.

One impediment to reducing the size of a cell phone is the antenna. Cell phone antennas need to extend to a length to sufficiently avoid interference with the human operator. The blocking effect of a human head can adversely affect the low power signal between a base station and a cell phone, thereby reducing the quality of communications. Since a cell phone antenna should retract into the cell phone housing for protection when not in use, the length of typical elongated conductor antennas used in cell phones must not exceed the overall housing length.

Presently, some of the smallest commercially available cell phones use a thin elongated flexible conductor. Two separate contacts are disposed on a printed circuit board within the phone to electrically contact a contact at the end of the antenna in separate retracted and extended positions. This simple elongated flexible conductor design is for protection and longevity. When extended outside of the housing, cell phone antennas are frequently subjected to forces which would permanently deform or break rigid conductors. For this reason, the retractable antenna designs used in other applications, such as automobile radio antennas, are avoided in cell phones and similar portable communicators.

In sum, cell phone antennas should be flexible, should retract for protection during times of nonuse, and should provide a sufficient length when extended to maximize signal quality by avoiding user interference, while also permitting the cell phone housing which accepts the antenna in its retracted state to be as small as possible. In addition to these specific desirable qualities, the performance of the antenna should be robust and should not significantly degrade from a small number of cycles of retraction and extension during use.

Size and operational improvements would result from an improved antenna which has an extended length exceeding that of its retracted length, maintains electrical contact in separate retracted and extended positions, and withstands operational cycling. There is therefore a need for an improved cell phone antenna which exhibits such qualities.

SUMMARY OF THE INVENTION

The present antenna retracts to a size within a portable communicator, such as a cell phone, which is smaller than the extended size of the antenna. A contact sleeve is capable of moving relative to an elongated conductor of the antenna, and is also capable of moving with the antenna, while allowing the antenna to maintain electrical contact with one or a plurality of electrical contact points within the communicator.

More specifically, the antenna of the present invention includes an elongated conductor that is coated with a protective material. An end of the conductor may include an additional helical conductor coated with a protective material. The helical conductor and elongated conductor are joined by an electrode. The size of the helical conductor is such that it also acts as a convenient grip for a user, and prevents the entire antenna from being pushed through a hole in the phone large enough to accommodate the elongated conductor.

For cell phones using direct electrical contact to internal circuits, there is an enlarged electrical contact opposite the end of the conductor including the helical conductor. The enlarged electrical contact is enclosed by an elongated conductive sleeve that is in a spring-loaded frictional engagement with the enlarged contact. The sleeve is preferably restricted at both ends, through crimping, tapering, press fitting, or other suitable means, so that the enlarged contact may not pass through either end. Relative movement between the sleeve and the enlarged contact is otherwise permitted over a range generally defined by the length of the sleeve. The sleeve moves with the enlarged contact between separate electrical contacts in the phone which directly or eventually complete electrical contact between the antenna and phone transmission and reception circuits.

When a user pulls the antenna upward, e.g. out of the housing, the enlarged contact and sleeve move together. The sleeve moves to a point at which further movement is prevented by contact with a portion of the cell phone housing or another fixed object. In a preferred embodiment, the sleeve is tapered so that it can pass through the hole for the elongated conductor and partially extend out of the housing. Further extension of the antenna is then realized by relative movement between the sleeve and the enlarged contact.

For phones having a capacitive coupling, the elongated sleeve need only be conductive on its inner surface. In this embodiment, the inner surface of the sleeve is preferably attached to an electrode which connects with the helical conductor. The enlarged contact is within the elongated sleeve, which is restricted at the end opposite the electrode. In a fully retracted position, the enlarged contact is at the electrode end of the sleeve and the sleeve is partially or fully within the housing, since it passes through the hole for the elongated conductor. When a user extends the antenna, the sleeve and contact move together until a non-conductive formation at the opposite end of the elongated conductor within the housing prevents further upward movement. Further extension is then realized by relative movement between the sleeve and the enlarged contact until the enlarged contact reaches the restricted end of the sleeve which is away from the electrode. This position is maintained as the antenna is retracted until the non-conductive formation reaches a stop within the housing which prevents further movement of the elongated conductor. Retraction is completed by relative movement between the sleeve and the enlarged contact.

For phones having a combination of direct and capacitive coupling, the elongated sleeve may be divided in two sections each of which have a contact within the sleeve. In a retracted position, the sleeve may contact a retracted electrical contact, while capacitive coupling may be used in the extended position. Since the sleeve is pulled completely out of the phone, the capacitive coupling is not shorted in the extended position.

BRIEF DESCRIPTION OF THE DRAWINGS

Other features and advantages of the invention will be apparent to those skilled in the art with reference to the detailed description and the drawings, of which:

FIG. 1(*b*) schematically depicts an antenna constructed in accordance with the present invention mounted in a portable communicator and in a fully extended position;

FIG. 2(*a*) is a partial cross section of a sleeve and contact in accordance with the present invention;

FIG. 2(*b*) is a full cross section of the sleeve shown in FIGS. 1(*a*), 1(*b*) and 2(*a*);

FIG. 2(*c*) shows a cap for use with the sleeve shown in FIG. 2(*b*);

FIG. 3(*b*) is a first side view of the FIG. 3(*a*) antenna;

FIG. 3(*c*) is an alternate side view of the FIG. 3(*a*) antenna;

FIG. 3(*d*) schematically depicts an antenna constructed in accordance with the second embodiment mounted in a portable communicator and in a fully retracted position;

FIG. 3(*e*) schematically depicts an antenna constructed in accordance with the second embodiment mounted in a portable communicator and in a fully extended position;

FIG. 3(*f*) schematically depicts an antenna constructed in accordance with a third embodiment mounted in a portable communicator and in a fully retracted position;

FIG. 3(*g*) schematically depicts an antenna constructed in accordance with the third embodiment mounted in a portable communicator and in a fully extended position;

FIG. 3(*h*) is a side cross section of a sleeve and dual contact structure of the third embodiment of the invention;

FIG. 6(*b*) is a perspective view of the bushing shown in FIG. 6(*a*)

DETAILED DESCRIPTION OF THE INVENTION

Figure 1A:
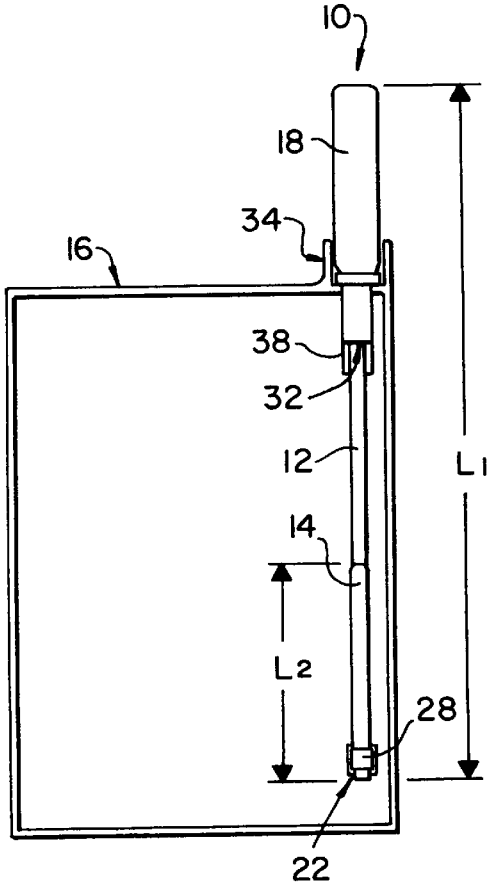
FIG. 1(*a*) schematically depicts an antenna constructed in accordance with the present invention mounted in a portable communicator and in a fully retracted position.

According to the present invention, a preferred embodiment of which is shown in FIGS. 1(*a*) and 1(*b*), an antenna 10 constructed primarily from a protectively coated thin, flexible elongated conductor 12 has a fully retracted length $L_1$ which is less than its fully extended length $L_2$. The length $L_3$ of an elongated contact sleeve 14 is approximately equal to the difference between $L_1$ and $L_2$. The elongated conductor 12 is flexible to prevent the antenna 10 from permanently deforming or breaking when it is subjected to external forces while in its extended position, shown in FIG. 1(*b*). Such forces frequently result from typical usage of a portable communicator 16, such as a cellular phone, in which the antenna 10 is installed, because of accidental contact with other objects or rough manipulation by a user of the portable communicator 16.

A protectively coated helical conductor 18 forms part of the antenna 10 and also forms a convenient grip for a user when the antenna 10 is in its retracted position, shown in FIG. 1(*a*). The helical conductor 18 is attached at an upper end 20 of the elongated conductor 12. An opposite end 22 of the elongated conductor 12 is within a bottom portion of the sleeve 14 in FIG. 1(*a*), and electrically contacts an inner surface 24 (shown in FIG. 2(*a*)) of the sleeve 14. Referring to FIG. 2(*a*), the electrical contact is preferably an enlarged contact 26, which exerts a spring force on the inner surface 24 to form a mechanical frictional engagement between the contact 26 and the sleeve 14. The sleeve 14 shown in FIG. 1(*a*) is formed from a conductor by machining or another suitable technique, so that electrical contact is established between the elongated conductor 12 and a retracted contact point 28 within the portable communicator 16 when the antenna 10 is in the FIG. 1(*a*) retracted state. The retracted contact point 28 is preferably shaped to accommodate a lower end of the sleeve 14 while also opposing downward movement of the sleeve 14. The retracted contact point 28 is directly or eventually connected to communication circuits 30 of the portable communicator 16, consisting, for example, of transmission and reception circuits.

By pulling up on the helical conductor 18, a user may extend the antenna out of the portable communicator 16. As the antenna 10 is extended, the sleeve 14 moves with the elongated conductor 12 as a result of the spring loaded frictional engagement between the contact 26 and the inner surface 24 of the sleeve 14. The elongated conductor 12 and a majority of the sleeve 14, excepting its lowermost portion 30, are sized to pass through a hole 32 in an antenna mount 34 of the portable communicator 16. As shown in FIG. 2(*b*), the lowermost portion 30 of the sleeve 14 is slightly enlarged to prevent passing through the hole 32. Referring again to FIGS. 1(*a*) and 1(*b*), the antenna 10 may also include a mounting ferrule 36 which couples with the mount 34 through a threaded engagement and through which the elongated conductor 12 and a majority of the sleeve 14 preferably also pass.

Upward joint movement of the elongated conductor 12 and the sleeve 14 continues until the lowermost portion 30 of the sleeve engages the mounting ferrule 36, an extended electrical contact point 38, or another fixed object proximate to a lower portion of the mounting ferrule 36. The extended electrical contact point 38 is also connected directly or eventually to the communication circuits 30, and is preferably shaped to accommodate and contact the sleeve 14, while also opposing further upward movement of the sleeve 14 after its lowermost portion 30 engages the extended electrical contact point 38. As seen in FIG. 1(*b*), the sleeve 14 of the preferred embodiment is allowed to partially pass outside of the portable communicator 16. In this position, the sleeve 14 makes electrical contact with the extended electrical contact point 38 and prevents the elongated conductor 12 from being pulled completely out of the portable communicator 16.

Once further upward movement of the sleeve 14 is prevented, further extension of the antenna 10 is realized by relative movement between the sleeve 14 and the elongated conductor 12. The force exerted by a user pulling upward overcomes the frictional engagement between the contact 26 and the inner surface 24 of the sleeve 14, allowing the contact to slide within the sleeve 14 while always maintaining electrical contact with its inner surface 24. As shown in FIG. 2(*a*), upward movement may continue until the contact 26 reaches a restricted end 40 of the sleeve 14, which may be crimped or tapered to form the restricted end 40. The length $L_3$ of the sleeve 14 therefore generally defines a range of relative movement between itself and the contact 26, and accordingly between itself and the elongated conductor 12.

Retraction back to the state shown in FIG. 1(*a*) is commenced when the user pushes down on the antenna 10. Normally, the sleeve 14 and the elongated conductor 12 will begin movement together as they did during initial extension of the antenna. However, it is possible that the sleeve 14 may, because of frictional contact with extended electrical contact point 38, the ferrule 36, or any other fixed object, resist initial movement with the elongated conductor 12. In the former case, relative movement between the contact 26 and the sleeve 14 to fully retract the antenna 10 occurs after the sleeve 14 engages the retracted contact point 28. In the latter case, the relative movement occurs as the first part of retraction and the joint movement after the contact 26 reaches the restricted sleeve's lowermost portion 30, which is also crimped or otherwise restricted to prevent passing of the contact 26 out of the sleeve 14. One alternative to crimping is shown in FIG. 2(*c*), which illustrates a locking cap 41 that may be used to plug the sleeve 14 at its lowermost portion 30.

Some cellular phones use a capacitive coupling to the elongated conductor 12. As shown in FIGS. 3(*d*)–3(*g*), the capacitive coupling element 28*a* is typically disposed in or around the antenna mount 34. In such phones, the conductive sleeve 14 would short the capacitive coupling when the antenna 10 reached its extended position if the sleeve 14 was within the capacitive coupling element 28*a*. However, the advantages of the present invention may still be obtained through the arrangement shown in FIGS. 3(*a*)–3(*e*).

FIGS. 3(*a*)–3(*e*) show an antenna 10 according to a second embodiment of the present invention in which the sleeve 14 is attached to the helical conductor 18 (shown without protective coating) via an electrode 42, e.g. at an opposite end of the elongated conductor 12 from the embodiment shown in FIGS. 1(*a*) and 1(*b*). The antenna's respective retracted and extended positions are respectively shown schematically in FIGS. 3(*d*) and 3(*e*), in which reference numerals from FIGS. 1(*a*) and 1(*b*) are used to identify identical parts. An additional nonconductive enlarged formation 43 is used to prevent passing of the entire antenna 10 out through the hole 32 in the antenna mount 34. With this arrangement, the communicator's contact points may be replaced by the capacitive coupling element 28*a*.

In the alternative arrangement of FIGS. 3(*a*)–(*e*), an outer surface 44 of the sleeve 14 need not be conductive since the sleeve 14 need only function to maintain electrical contact between the electrode 42 and the contact 26. Preferably, the outer surface is coated with a protective material, such as plastic, along with the coating applied to the helical conductor 18. Alternatively, the entire sleeve 14 may be formed from a non-conductive material such as platable plastic with its inner surface 24 being coated with conductive material through plating or other suitable methods.

The operation of the sleeve 14 in FIGS. 3(*a*)–3(*e*) mirrors that of the FIGS. 1(*a*)–1(*b*) arrangement, with the sleeve 14 and contact 26 moving jointly during initial retraction and extension, and moving relative to each other to complete retraction and extension. Referring to FIGS. 3(*d*) and 3(*e*), relative movement to complete extension is commenced when the nonconductive formation 43 reaches the bottom portion of the hole 32 in the antenna mount 34. Relative movement to complete retraction is commenced when the formation 43 reaches a stop 43*a*, or if no stop is used, when it reaches an inner surface of the portable communicator 16. As pointed out above, the order of relative and joint movement may change without adversely affecting operation of the antenna 10.

Another configuration is shown in 3(*f*)–3(*h*), and is useful, for example, when capacitive coupling is used in an extended state and direct coupling is used in the retracted state. In this third embodiment, the elongated conductor is divided into two sections 12*a* and 12*b*, each of which includes a separate contact 26*a*, 26*b* (shown in FIG. 3(*h*)) within the sleeve 14. The sleeve makes direct electrical contact with the retracted contact point 28 in the retracted state of FIG. 3(*f*), while capacitive coupling is realized in the extended position shown in FIG. 3(*g*). Similarly to the FIGS. 3(*a*)–3(*e*) embodiment, extension is commenced with joint movement as both sections 12*a*, 12*b* and the sleeve 14 move together. Extension is completed through relative movement commenced when the nonconductive formation 43 reaches the hole 32 at the bottom of the mounting ferrule 36. Retraction is completed through relative movement commenced when the nonconductive formation 43 reaches the stop 43*a*, or if no stop is used, when it reaches an inner surface of the communicator 16 or some other fixed object. As pointed out above, the order of relative and joint movement may change without adversely affecting operation of the antenna 10.

Referring again to FIGS. 3(*a*)–3(*c*), the sructure of a preferred elongated conductor 12, sleeve 14, and contact 26 are shown in more detail. The contact structure is illustrative of the sleeve and contact engagement for any of the illustrated embodiments, and also shows the specific sleeve mounting arrangement of the second embodiment. The conductive portion of the elongated conductor 12 may be a thin, solid, elongate, and flexible metallic core 46. Other arrangements, such as wrapped, helical, or wound conductors are also suitable. A protective coating 48 of plastic, rubber or other suitable insulator surrounds the core 46, but leaves an exposed portion 50 at one end for attachment of the contact 26. The contact 26 is attached to the exposed portion 50 via crimping or other suitable means.

The contact 26 includes plural legs 54 which exert spring force on the sleeve's inner surface 24. The legs 54 have a natural distance of separation from each other which is greater than that permitted by the inner diameter of the sleeve 14. Accordingly, the legs are pushed together so that their distance of separation is reduced when within the sleeve 14, as is best seen in FIG. 2(*a*).

To facilitate entry of the sleeve 14 into the hole 32 in the antenna mount 34, the sleeve 14 preferably has a tapered end 56, or in the third embodiment of FIGS. 3(*f*) and 3(*g*), two tapered ends since both need to pass through the hole 32. Both ends of the sleeve 14 should be restricted by a crimp 58 or other means to prevent passing of the contact 26 out of the sleeve. In the second embodiment shown in FIGS. 3(*a*)–3(*e*), one end of the sleeve 14 need not be restricted since the electrode 42 will prevent passing of the contact 26.

Figure 5:
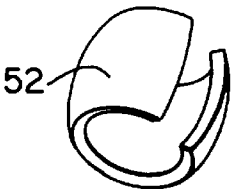
FIG. 5 is a preferred clip for an alternate contact shown in FIGS. 6(*a*)–6(*b*)
Figure 4:
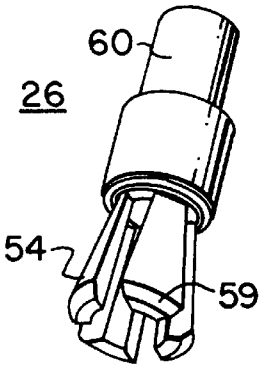
FIG. 4 is a perspective view of a preferred contact shown in FIGS. 3(*a*)–3(*c*)

The contact 26 is also shown in FIG. 4, and has rounded portions 59 that facilitate sliding movement when the contact 26 is in the sleeve. An alternate contact 26*a* is shown in FIGS. 5 and 6 and includes a collar 62 above and below a neck 60. The collar 62 positions a clip 63, which will exert a spring force on the inner surface 24 of the sleeve 14. The neck 60 is crimped or otherwise locked on the exposed portion 50, and electrical contact to sleeve 14 is through the neck 60 and clip 63. A second alternate contact 26*b* is shown in FIG. 7, and includes a neck 60 and collar 62, with legs 54.

Other alterations and modifications will be apparent to those skilled in the art. Accordingly, the scope of the invention is not limited to the specific embodiments used to illustrate the principles of the invention. Instead, the scope of the invention is properly determined by reference to the appended claims and any legal equivalents thereof.

What is claimed is:

1. A retractable antenna for a portable communicator including a housing having an antenna mount with a hole, the antenna comprising:

an elongated conductor, said elongated conductor being sized to pass through the hole of the antenna mount;

a protective coating on said elongated conductor;

an enlarged electrical contact disposed on said elongated conductor; and an elongated electrical contact sleeve surrounding and contacting said contact, said contact and said sleeve maintaining electrical contact with each other through spring force exerted on an inner surface of said sleeve by said contact while being movable with each other as the antenna is moved between retracted and extended positions relative to the housing, said contact and said sleeve further being movable relative to each other so that the antenna may be extended further when further extension of the sleeve is prevented and so that the antenna may be retracted further when further retraction of the sleeve is prevented.

2. The antenna according to claim 1, the portable communicator having a retracted contact point and an extended contact point within the housing, wherein:

said contact and said sleeve are disposed at an end of said elongated conductor to be disposed within the housing so said sleeve will electrically contact the retracted contact point when the antenna is in a retracted position and electrically contact the extended contact point when the antenna is in an extended position.

3. The antenna according to claim 2, wherein ends of the sleeve are restricted to prevent passing of the contact.

4. The antenna according to claim 3, where the ends of the sleeve are crimped.

5. The antenna according to claim 2, wherein said sleeve includes a tapered end disposed toward a middle portion of said elongated conductor, said tapered end being sized to pass through the hole.

6. The antenna according to claim 5, wherein said sleeve is sized to pass through the hole except at its lower end.

7. The antenna according to claim 2, wherein the lenght of said sleeve between its ends defines a range of relative movement between said enlarged contact and said sleeve.

8. The antenna according to claim 1, wherein said contact includes plural legs separated from each other having a natural distance of separation greater than that permitted by the inner surface of said sleeve.

9. The antenna according to claim 1, further comprising:

a helical conductor; and an electrode connected to and electrically contacting an end of said helical conductor and an upper end of said sleeve.

10. The antenna according to claim 9, wherein an outer surface of said sleeve is nonconductive and an inner surface of said sleeve is conductive.

11. The antenna according to claim 9, wherein said contact is formed at an end of said elongated conductor disposed in said sleeve and further comprising a nonconductive formation at an opposite end of said elongate conductor from said contact, said formation having a portion larger than the hole.

12. The antenna according to claim 9, wherein a lower end of said sleeve is restricted to prevent passing of said contact.

13. The antenna according to claim 12, where the lower end of said sleeve is crimped.

14. The antenna according to claim 9, wherein said sleeve includes a tapered end disposed toward a middle portion of said elongated conductor, said tapered end being sized to pass through the hole.

15. The antenna according to claim 14, wherein said sleeve is sized to pass through the hole in its entirety.

16. The antenna according to claim 9, wherein the length of said sleeve between its ends defines a range of relative movement between said enlarged contact and said sleeve.

17. The antenna according to claim 9, wherein said contact includes plural legs separated from each other having a natural distance of separation greater than that permitted by the inner surface of said sleeve.

18. The antenna according to claim 1, wherein said elongated conductor is formed from two sections, and each section has a contact disposed in said sleeve which is movable with said sleeve and movable relative to said sleeve.

19. The antenna according to claim 18, wherein said sleeve is formed from conductive material.

20. The antenna according to claim 18, wherein lower and upper ends of said sleeve are resticted to prevent passing of said contacts out of said sleeve.

21. The antenna according to claim 20, where the lower and upper ends of said sleeve are crimped.

22. The antenna according to claim 18, wherein upper and lower ends of said sleeve are tapered and said sleeve is sized to pass through the hole in its entirety.

23. The antenna according to claim 18, wherein the length of said sleeve between its ends defines a range of relative movement between said contacts and said sleeve.

24. The antenna according to claim 23, wherein said contacts separately exert a spring force on an inner surface of said sleeve.

25. The antenna according to claim 24, wherein each of said contacts includes plural legs separated from each other having a natural distance of separation greater than that permitted by the inner surface of said sleeve.

26. A retractable antenna for a portable communicator including a housing having an antenna mount with a hole, the antenna comprising:

an elongated conductor sized to pass through the hole;

an enlarged spring contact disposed on a potion of said elongated conductor; and continuous electical contact means for continuously compressing said enlarged spring contact to maintain electrical contact therewith and for connecting the enlarged contact to another conductive element, said continuous electrical contact means being movable with the enlarged contact and being movable relative to the enlarged contact.

27. The antenna according to claim 26, wherein said another conductive element comprises:

a retracted contact point within the portable communicator which is electrically contacted when the antenna is in a retracted position; and an extended contact point within the portable communicator which is electrically contacted when the antenna is in an extended position.

28. The antenna according to claim 26, wherein said another conductive element comprises an electrode and a helical conductor sized to prevent passing of the helical conductor through the hole.

29. The antenna according to claim 28, wherein further comprising a nonconductive formation at an opposite end of the elongated conductor from the contact, said formation having a portion larger than the hole.

30. The antenna according to claim 26, wherein said continuous contact means and said contact are mechanically engaged and said continuous contact means includes means for preventing separation of said contact and said continuous contact means.

31. The antenna according to claim 26, wherein a length of said continuous contact means defines a range of relative movement between said contact and said continuouse contact means.

32. A retractable antenna for a portable communicator having an antenna mount with a hole, the antenna comprising:

an elongated conductor sized to pass through the hole;

an electrical contact sleeve disposed around at least a potion of said elongated conductor; and an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor.

33. The antenna according to claim 32, wherein said enlarged spring contact includes a plurality of legs separated from each other having a natural distance of separation greater than that permitted by the inner surface of said sleeve.

* * * * *

US006034639C1

(12) EX PARTE REEXAMINATION CERTIFICATE (6313th)

United States Patent
Rawlins et al.

(10) Number: US 6,034,639 C1
(45) Certificate Issued: Jul. 22, 2008

(54) RETRACTABLE ANTENNA FOR PORTABLE COMMUNICATOR

(75) Inventors: Roger R. Rawlins, Mundelein, IL (US); Brian L. Hahn, Buffalo Grove, IL (US); Stephan D. Memmen, Lincolnshire, IL (US)

(73) Assignee: T & M Antennas, Wheeling, IL (US)

Reexamination Request:
No. 90/006,007, May 14, 2001

Reexamination Certificate for:

| | |
|---|---|
| Patent No.: | **6,034,639** |
| Issued: | **Mar. 7, 2000** |
| Appl. No.: | **08/995,489** |
| Filed: | **Dec. 22, 1997** |

(51) Int. Cl.
*H01Q 1/24* (2006.01)
*H01Q 1/36* (2006.01)

(52) U.S. Cl. ..... 343/702; 343/895; 343/901; 343/729

(58) Field of Classification Search ..... 343/702, 343/729, 895, 901, 906
See application file for complete search history.

(56) References Cited

U.S. PATENT DOCUMENTS

| | | | | |
|---|---|---|---|---|
| 2,491,601 | A | 12/1949 | Bernstein et al. | 343/901 |
| 4,353,075 | A | 10/1982 | Edwards | 343/903 |
| 4,956,647 | A | 9/1990 | Kimura | 343/901 |
| 5,079,558 | A | 1/1992 | Koike | 343/702 |
| 5,245,350 | A | 9/1993 | Sroka | 343/702 |
| 5,302,963 | A | 4/1994 | Wiggenhron | 343/901 |
| 5,353,036 | A | 10/1994 | Baldry | 343/702 |
| 5,389,938 | A | 2/1995 | Harrison | 343/702 |
| 5,412,393 | A | 5/1995 | Wiggenhorn | 343/702 |
| 5,455,595 | A | 10/1995 | Yokoyama et al. | 343/702 |
| 5,467,097 | A | 11/1995 | Toko | 343/702 |
| 5,521,605 | A | 5/1996 | Koike | 343/702 |
| 5,583,519 | A | 12/1996 | Koike | 343/702 |
| 5,699,070 | A | 12/1997 | Mischenko et al. | 343/702 |
| 5,717,408 | A | 2/1998 | Sullivan et al. | 343/702 |
| 5,836,072 | A | 11/1998 | Sullivan et al. | 29/600 |
| 5,859,617 | A | 1/1999 | Fujikawa | 343/702 |
| 5,909,194 | A | 6/1999 | Umeda et al. | 343/702 |
| 5,914,689 | A | 6/1999 | Cockson | 343/702 |
| 5,945,952 | A | 8/1999 | Davidson | 343/702 |
| 5,969,694 | A | 10/1999 | Harada et al. | 343/901 |
| 6,002,372 | A | 12/1999 | Sullivan | 343/702 |
| 6,014,106 | A | 1/2000 | Annamaa | 343/702 |
| 6,018,321 | A | 1/2000 | Simmons et al. | 343/702 |
| 6,075,489 | A | 6/2000 | Sullivan | 343/702 |
| 6,137,452 | A | 10/2000 | Sullivan | 343/873 |
| 6,150,994 | A | 11/2000 | Winter et al. | 343/895 |
| 6,166,696 | A | 12/2000 | Chenoweth et al. | 343/702 |
| 6,188,918 | B1 | 2/2001 | Cockson | 455/575 |
| 6,198,443 | B1 | 3/2001 | Powles et al. | 343/702 |
| 6,215,446 | B1 | 4/2001 | Sullivan et al. | 343/702 |

FOREIGN PATENT DOCUMENTS

| | | |
|---|---|---|
| JP | 03245603 | 2/1990 |

*Primary Examiner*—Tan Ho

(57) ABSTRACT

A retractable antenna for a portable communication device. The antenna retracts to a size within a portable communicator, such as a cell phone, which is smaller than the extended size of the antenna, while being flexible and otherwise suitable for the demanding environment of portable communicators. The antenna includes a contact sleeve which moves relative to an enlongated conductor of the antenna, and also moves with the antenna while allowing the antenna to maintain electrical contact with another element in the antenna or the communicator. The sleeve may be connected to a helical conductor which forms part of the antenna and remains outside the housing of the portable communicator. Alternatively, the sleeve may be conductive on its inner and outer portions to move with and connect the elongated conductor to separate retracted and extended contact points within the portable communicator. Separate sections of elongated conductor may also extend separately from ends of the sleeve, with each being relatively movable. The antenna is accordingly adaptable to direct electrical contact, capacitive coupling, or a combination of both. The preferred antenna includes an elongated conductor having an enlarged contact which is spring loaded into the sleeve.

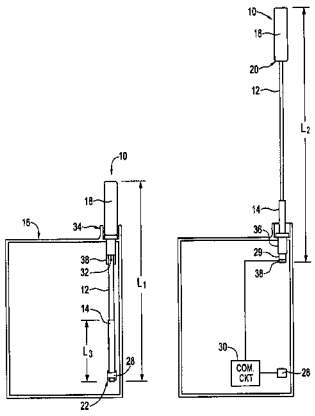

(Amended) (Amended)

Figure 1B:
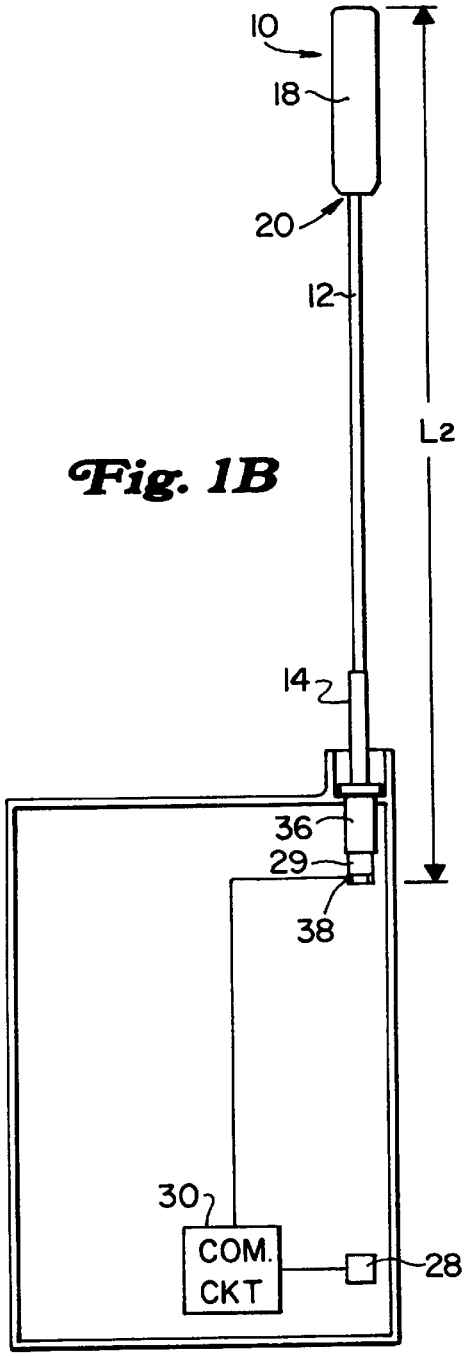

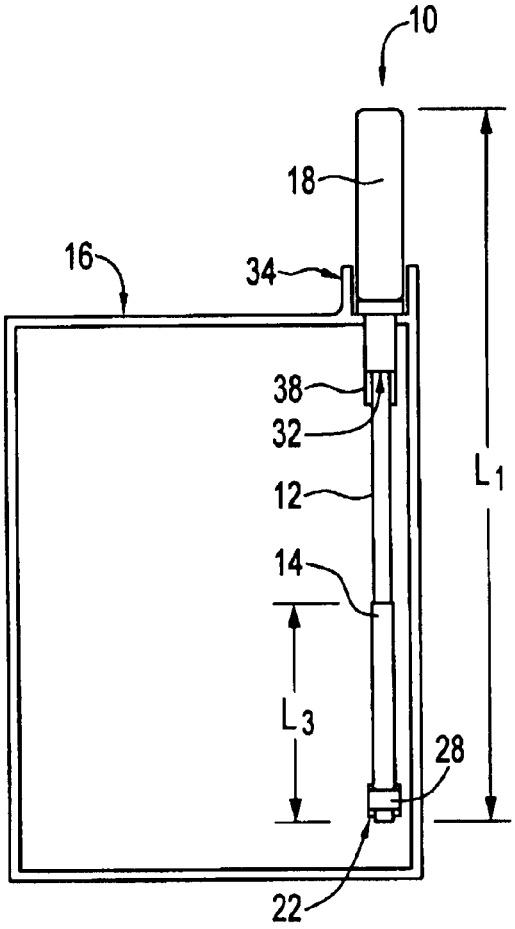
FIG. 1(a)
(Amended)
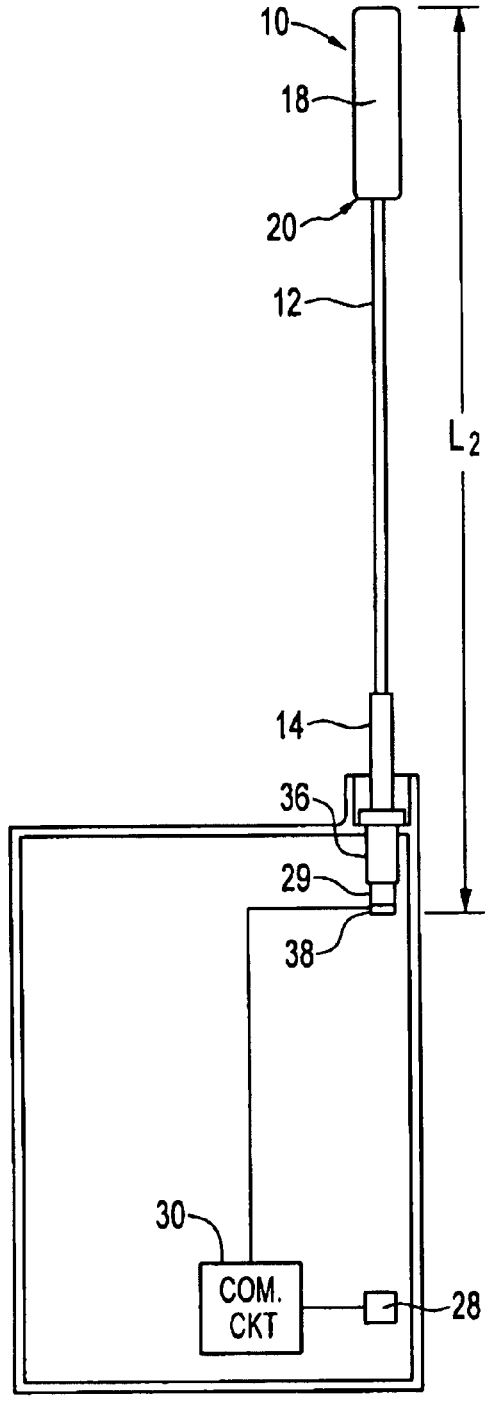
FIG. 1(b)
(Amended)

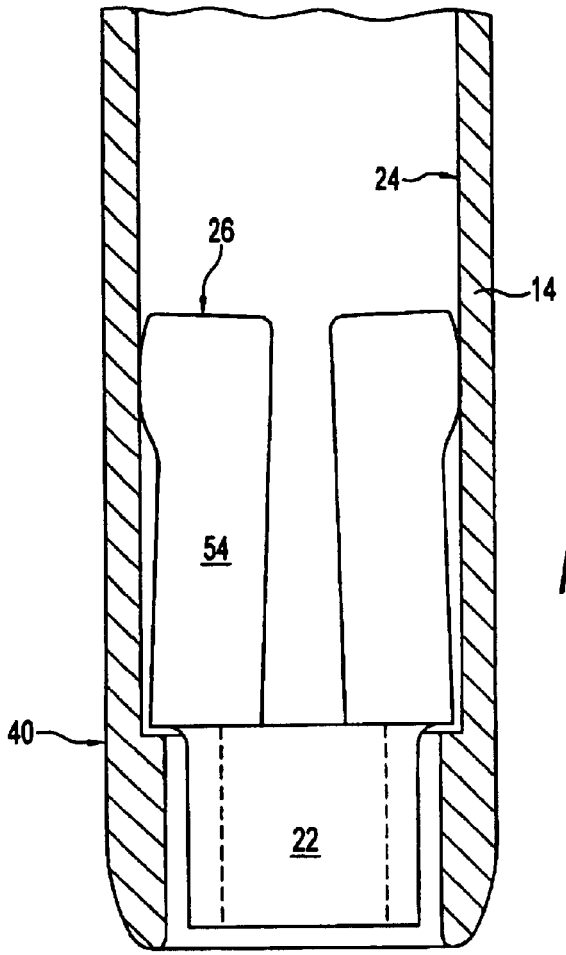
FIG. 2(a)
(Amended)
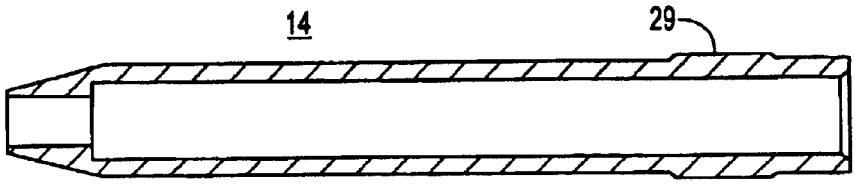
FIG. 2(b)
(Amended)
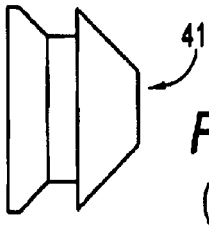
FIG. 2(c)
(Amended)

Figure 3A:
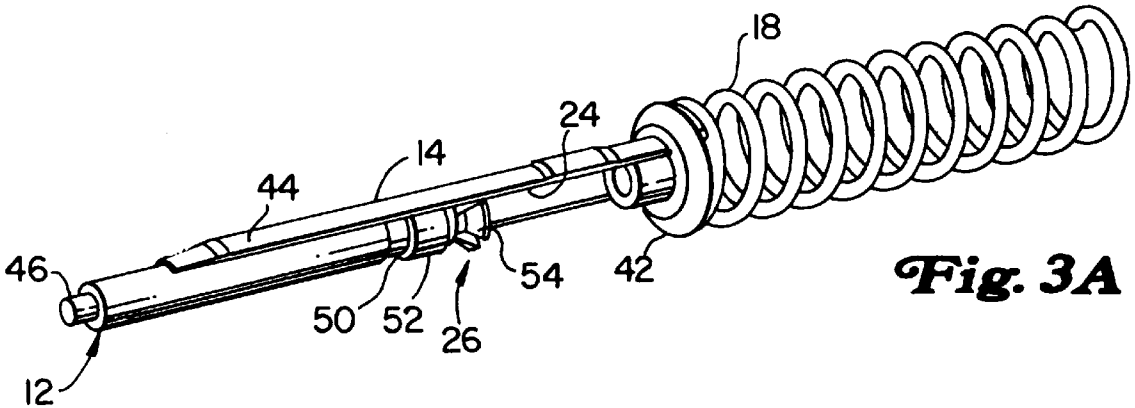
FIG. 3(*a*) is a perspective and partially cut away view of an uncoated antenna according to a second embodiment of the present invention for use with a capacitive coupled portable communicator.
Figure 3B:
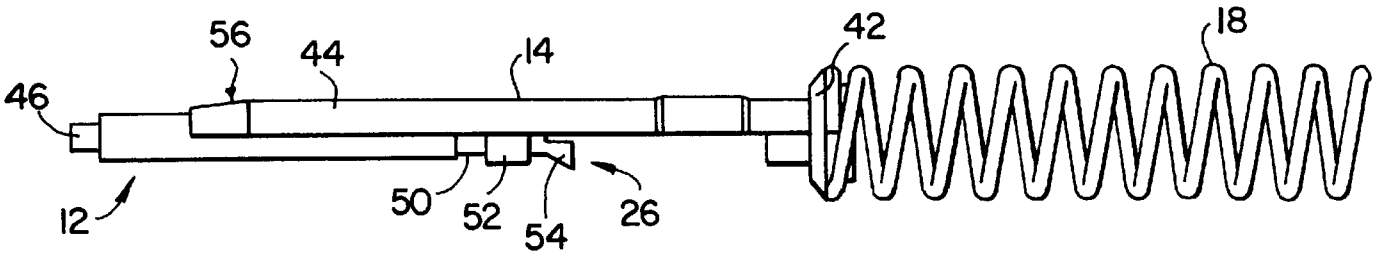
Figure 3C:
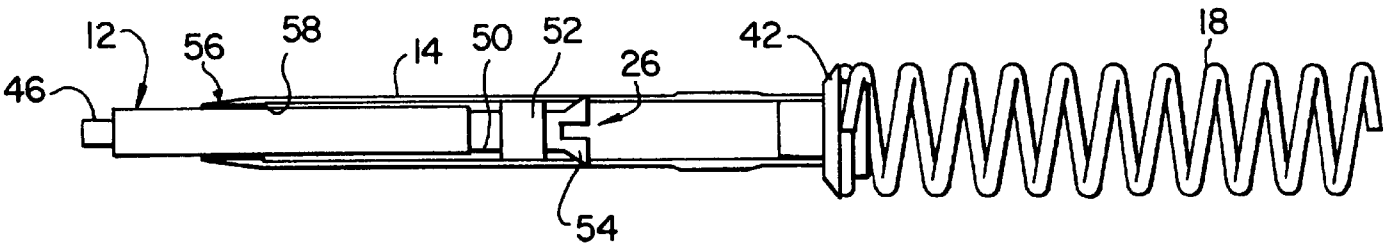

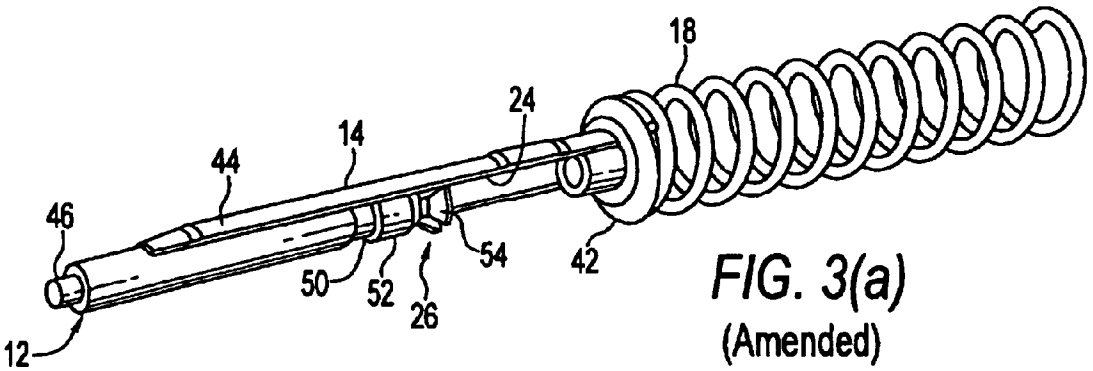
FIG. 3(a)
(Amended)
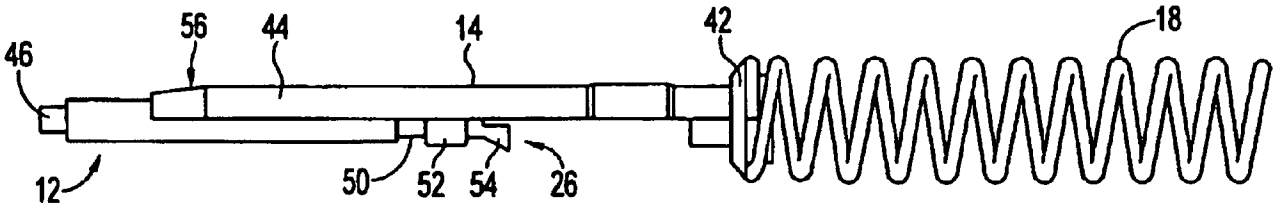
FIG. 3(b)
(Amended)
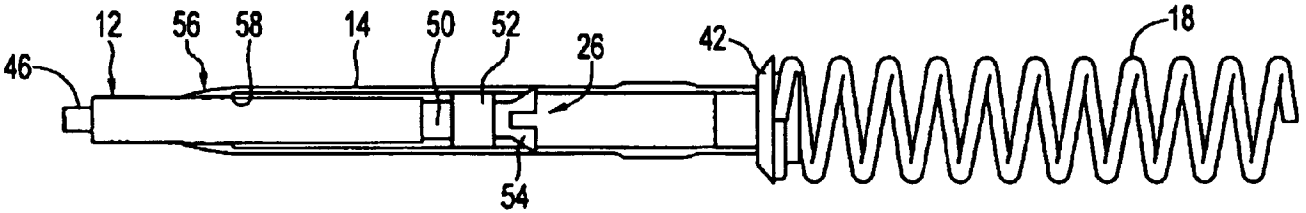
FIG. 3(c)
(Amended)

Figure 3D:
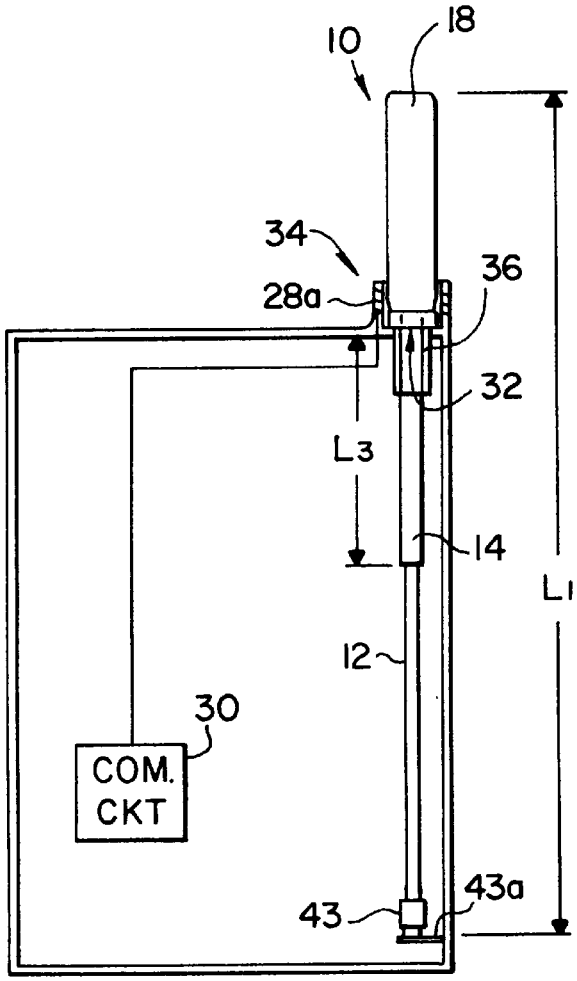
Figure 3E:
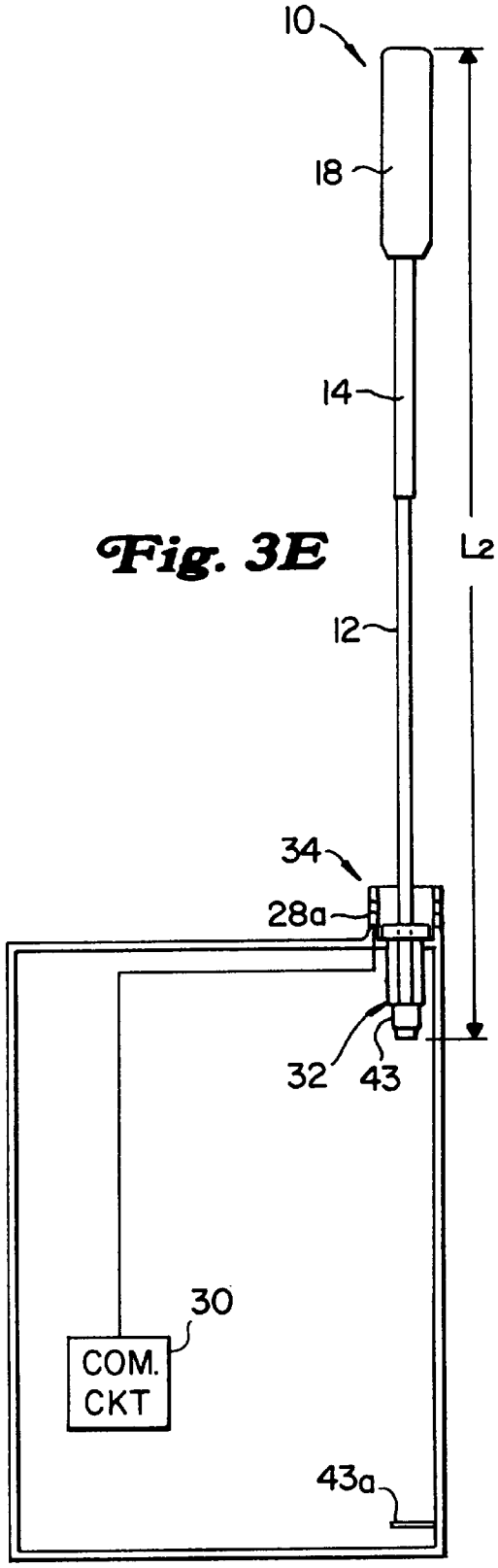

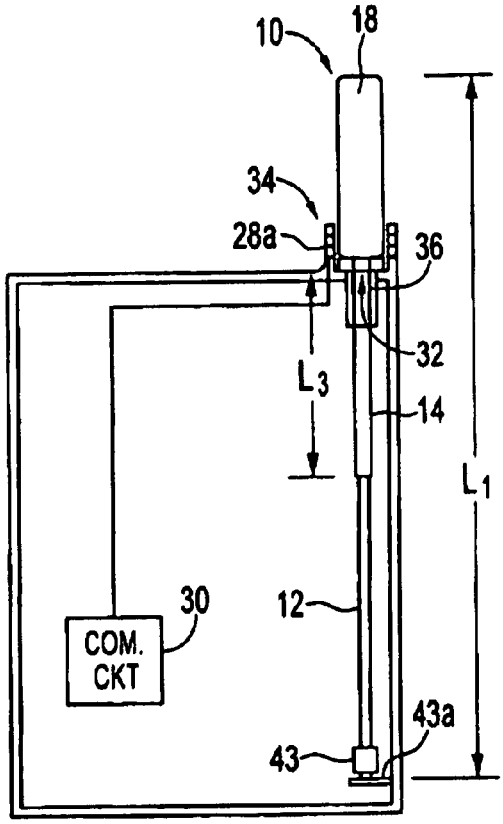
FIG. 3(d)
(Amended)
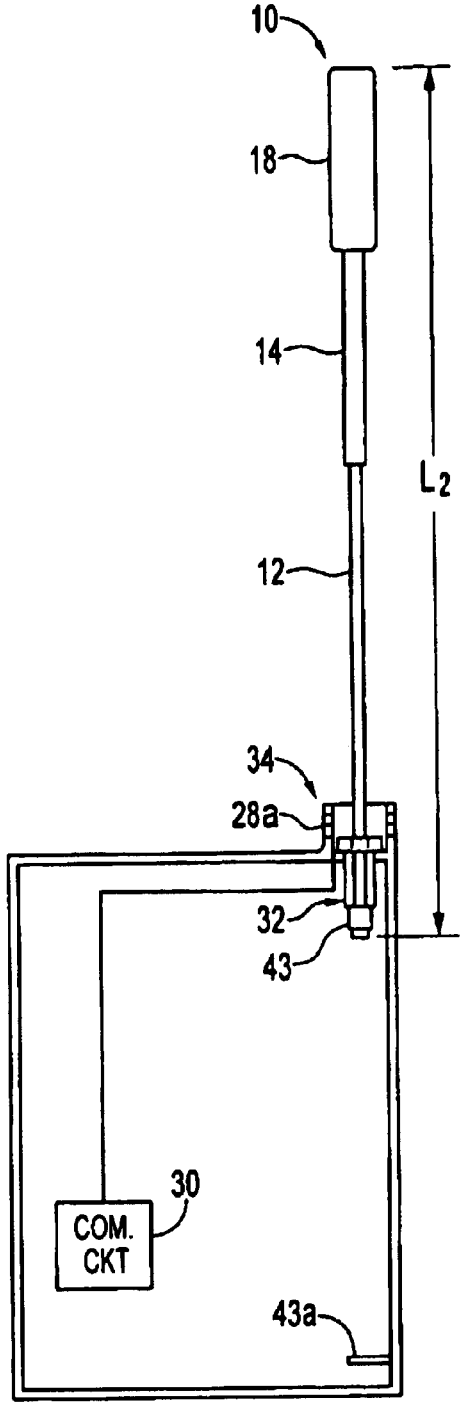
FIG. 3(e)
(Amended)

Figure 3F:
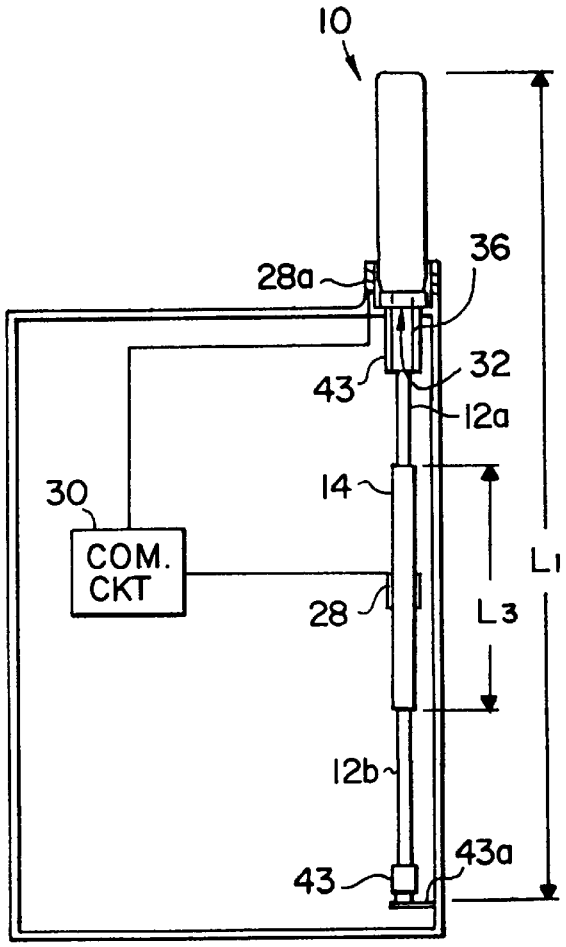
Figure 3G:
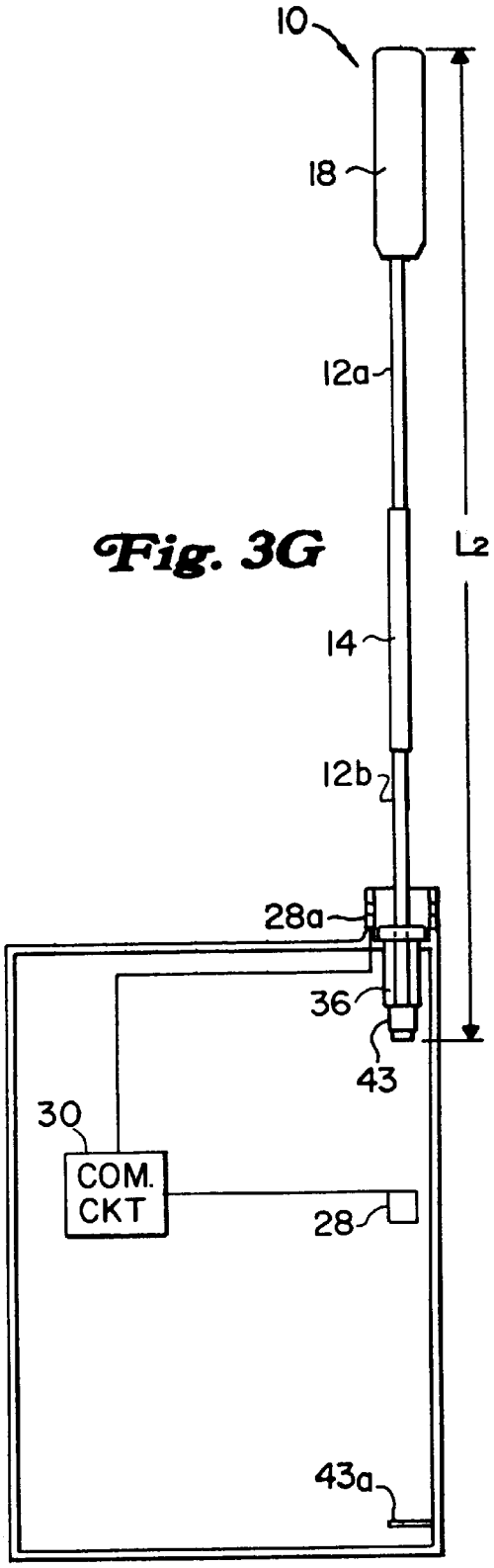

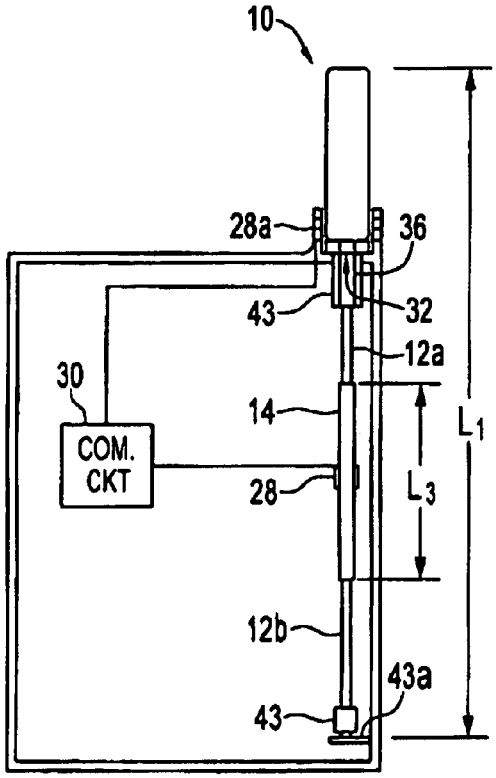
FIG. 3(f)
(Amended)
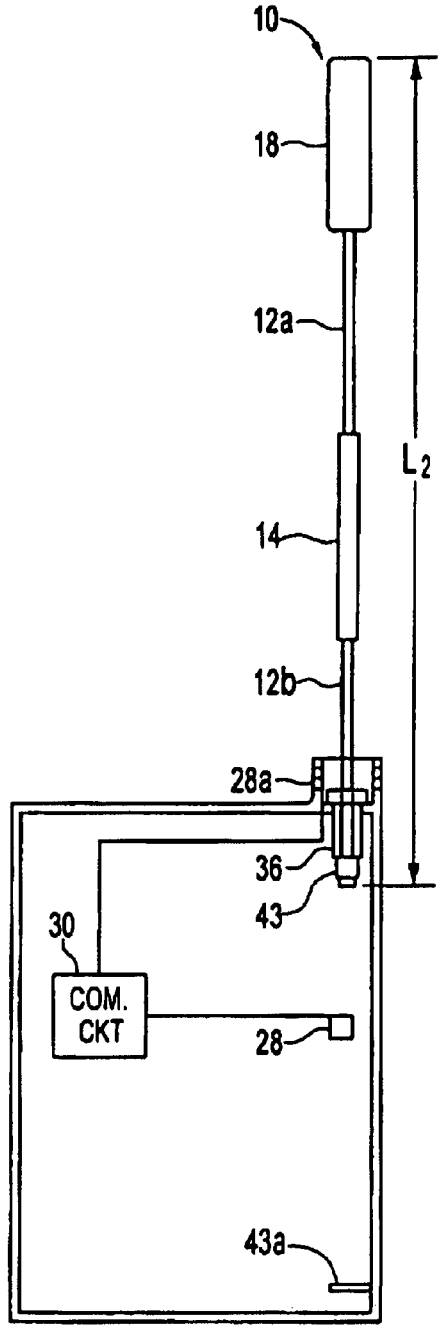
FIG. 3(g)
(Amended)

Figure 3H:
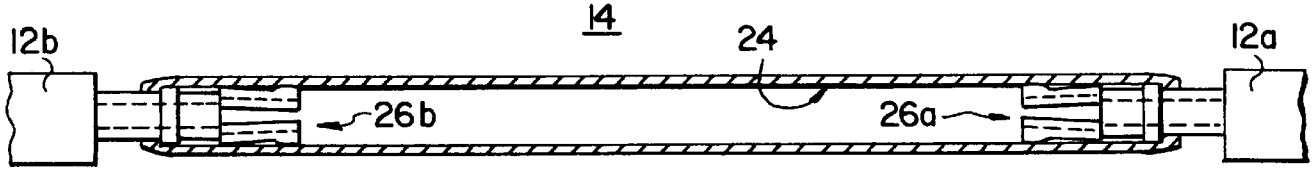
Figure 6B:
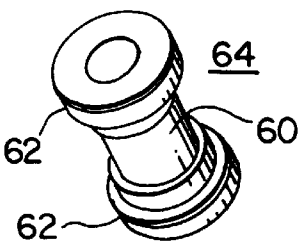
FIG. 6(*a*) is a perspective view showing the alternate contact.
Figure 6A:
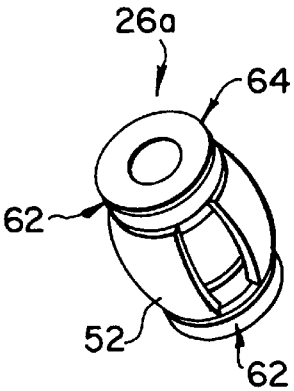
Figure 7:
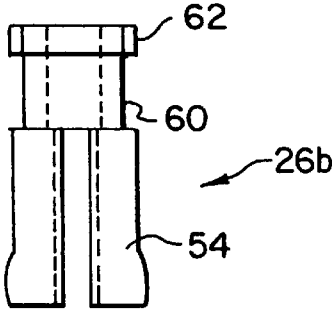
FIG. 7 is a side view of a second alternate contact.
Figure 4:
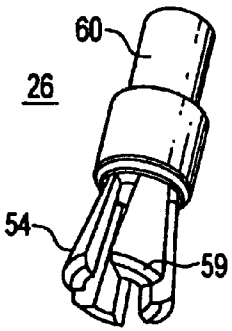

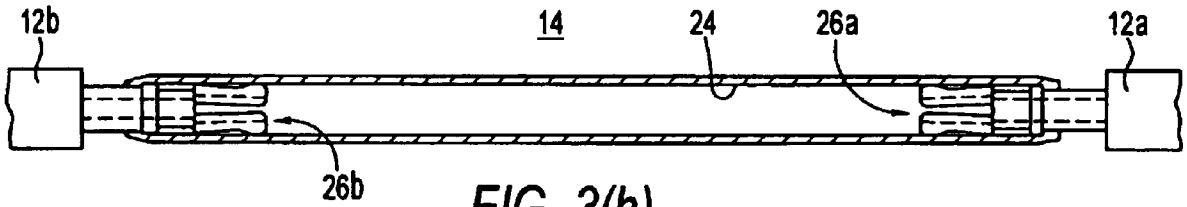
FIG. 3(h)
(Amended)
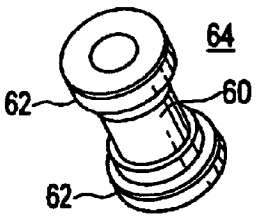
FIG. 6(b)
(Amended)
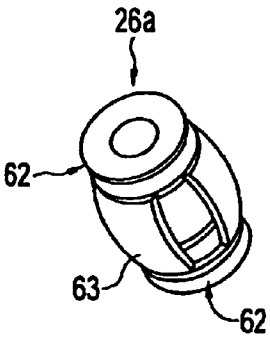
FIG. 6(a)
(Amended)
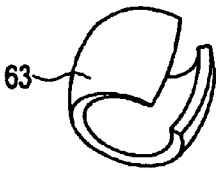
FIG. 5
(Amended)
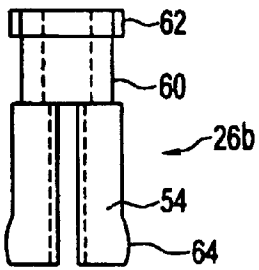
FIG. 7
(Amended)

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent

ONLY THOSE PARAGRAPHS OF THE SPECIFICATION AFFECTED BY AMENDMENT ARE PRINTED HEREIN.

Column 4, lines 21–36:

By pulling up on the helical conductor 18, a user may extend the antenna out of the portable communicator 16. As the antenna 10 is extended, the sleeve 14 moves with the enlongated conductor 12 as a result of the spring loaded frictional engagement between the contact 26 and the inner surface 24 of the sleeve 14. The enlongated conductor 12 and a majority of the sleeve 14, excepting its lowermost portion [30] *29*, are sized to pass through a hole 32 in an antenna mount 34 of the portable communicator 16. As shown in FIG. 2(b), the lowermost portion [30] *29* of the sleeve 14 is slightly enlarged to prevent passing through the hole 32. Referring again to FIGS. 1(a) and 1(b), the antenna 10 may also include a mounting ferrule 36 which couples with the mount 34 through a threaded engagement and through which the elongated conductor 12 and a majority of the sleeve 14 preferably also pass.

Column 4, lines 37–53:

Upward joint movement of the elongated conductor 12 and the sleeve 14 continues until the lowermost portion [30] *29* of the sleeve engages the mounting ferrule 36, an extended electrical contact point 38, or another fixed object proximate to a lower portion of the mounting ferrule 36. The extended electrical contact point 38 is also connected directly or eventually to the communication circuits 30, and is preferably shaped to accommodate and contact the sleeve 14, while also opposing further upward movement of the sleeve 14 after its lowermost portion [30] *29* engages the extended electrical contact point 38. As seen in FIG. 1(b), the sleeve 14 of the preferred embodiment is allowed to partially pass outside of the portable communicator 16. In this position, the sleeve 14 makes electrical contact with the extended electrical contact point 38 and prevents the elongated conductor 12 from being pulled completely out of the portable communicator 16.

Column 5, lines 1–18:

Retraction back to the state shown in FIG. 1(a) is commenced when the user pushes down on the antenna 10. Normally, the sleeve 14 and the elongated conductor 12 will begin movement together as they did during initial extension of the antenna. However, it is possible that the sleeve 14 may, because of frictional contact with extended electrical contact point 38, the ferrule 36, or any other fixed object, resist initial movement with the elongated conductor 12. In the former case, relative movement between the contact 26 and the sleeve 14 to fully retract the antenna 10 occurs after the sleeve 14 engages the retracted contact point 28. In the latter case, the relative movement occurs as the first part of retraction and the joint movement after the contact 26 reaches the restricted sleeve's lowermost portion [30] *29*, which is also crimped or otherwise restricted to prevent passing of the contact 26 out of the sleeve 14. One alternative to crimping is shown in FIG. 2(c), which illustrates a locking cap 41 that may be used to plug the sleeve 14 at its lowermost portion [30] *29*.

Column 6, lines 52–61:

The contact 26 is also shown in FIG. 4, and has rounded portions 59 that facilitate sliding movement when the contact 26 is in the sleeve. An alternate contact 26a is shown in FIGS. 5 and 6 and includes a collar 62 above and below a neck 60. The collar 62 positions a clip 63, which will exert a spring force on the inner surface 24 of the sleeve 14. The neck 60 is crimped or otherwise locked on the exposed portion 50, and electrical contact to sleeve 14 is through the neck 60 and clip 63. A second alternate contact 26b is shown in FIG. 7, and includes a neck 60 and collar 62, with legs 54 *having round bulbous portions 64 near their ends*.

THE DRAWING FIGURES HAVE BEEN CHANGED AS FOLLOWS:

Upper case alphas changed to lower case alphas in all Figures. Part number L2 changed to L3 in FIG. 1*a*. Part Number 52 changed to 63 in FIGS. 5 and 6*a*.

AS A RESULT OF REEXAMINATION, IT HAS BEEN DETERMINED THAT:

The patentability of claims 1–6 and 8 is confirmed.

Claims 9, 12, 13, 16, 26–28 and 30–32 are cancelled.

Claims 7, 10, 11, 14, 17, 18, 20, 29 and 33 are determined to be patentable as amended.

Claims 15, 19 and 21–25, dependent on an amended claim, are determined to be patentable.

New claims 34–72 are added and determined to be patentable.

7. The antenna according to claim 2, wherein the [lenght] *length* of said sleeve between its ends defines a range of relative movement between said [enlarged] contact and said sleeve.

10. [The antenna according to claim 9.] *A retractable antenna for a portable communicator having an antenna mount with a hole, the antenna comprising:*

*an enlongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*a helical conductor; and*

*an electrode connected to and electrically contacting an end of said helical conductor and an upper end of said sleeve,* wherein an outer surface of said sleeve is nonconductive and an inner surface of said sleeve is conductive.

11. [The antenna according to claim 9.] *A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*a helical conductor; and*

*an electrode connected to and electrically contacting an end of said helical conductor and an upper end of said sleeve,* wherein said contact is formed at an end of said elongated conductor disposed in said sleeve and fuurther comprising a nonconductive formation at an opposite end of said elongate conductor from said contact, said formation having a portion larger than the hole.

14. [The antenna according to claim 9,] *A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*a helical conductor; and*

*an electrode connected to and electrically contacting an end of said helical conductor and an upper end of said sleeve,* wherein said sleeve includes a tapered end disposed toward a middle portion of said elongated conductor, said tapered end being sized to pass through the hole.

17. [The antenna according to claim 9,] *A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*a helical conductor; and*

*an electrode connected to and electrically contacting an end of said helical conductor and an upper end of said sleeve,* wherein said contact includes plural legs separated from each other having a natural distance of separation greater than that permitted by the inner surface of said sleeve.

18. [The antenna according to claim 1,] *A retractable antenna for a portable communicator having an antenna mount with a hole, the antenna comprising:*

*an elongated conductor sized to pass through the hole;*

*an electrical contact sleeve disposed around at least a portion of said elongated conductor;*

*and an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;* wherein said elongated conductor is formed from two sections, and each section has a contact disposed in said sleeve which is movable with said sleeve and movable relative to said sleeve.

20. The antenna according to claim 18, wherein lower and upper ends of said sleeve are [resticted] *restricted* to prevent passing of said contacts out of said sleeve.

29. [The antenna according to claim 28, wherein] *A retractable antenna for a portable communicator including a housing having an antenna mount with a hole, the antenna comprising:*

*an elongated conductor sized to pass through the hole;*

*an enlarged spring contact disposed on a portion of said elongated conductor; and*

*continuous electrical contact means for continuously compressing said enlarged spring contact to maintain electrical contact therewith and for connecting the enlarged contact to another conductive element, said continuous electrical contact means being movable with the enlarged contact and being movable relative to the enlarged contact;*

*wherein said another conductive element comprises an electrode and a helical conductor sized to prevent passing of the helical conductor through the hole;* further comprising a nonconductive formation at an opposite end of the elongated conductor from the contact, said formation having a portion larger than the hole.

33. [The antenna according to claim 32,] *A retractable antenna for a portable communicator having an antenna mount with a hole, the antenna comprising:*

*an elongated conductor sized to pass throught the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;* wherein said enlarged spring contact includes a plurality of legs separated from each other having a natural distance of separation greater than that permitted by the inner surface of said sleeve.

*34. The antenna according to claim 1, wherein the elongated conductor is flexible when in the extended position.*

*35. The antenna according to claim 1, being flexible in the extended position.*

*36. The antenna according to claim 35, wherein said sleeve has a length such that it only partially extends from the housing in the extended position.*

*37. The antenna according to claim 1, wherein said sleeve has a length such that it only partially extends from the housing in the extended position.*

*38. The antenna according to claim 37, wherein said elongated conductor and said sleeve are configured to permit the antenna to be flexed in the extended position without permanently deforming or breaking.*

*39. The antenna according to claim 1, wherein said elongated conductor and said sleeve are configured to permit the antenna to be flexed in the extended position without permanently deforming or breaking.*

*40. The antenna according to claim 2, wherein the elongated conductor is flexible when in the extended position.*

*41. The antenna according to claim 2, being flexible in the extended position.*

*42. The antenna according to claim 41, wherein said sleeve has a length such that it only partially extends from the housing in the extended position.*

*43. The antenna according to claim 2, wherein said sleeve has a length such that it only partially extends from the housing in the extended position.*

*44. The antenna according to claim 43, wherein said elongated conductor and said sleeve are configured to permit the antenna to be flexed in the extended position without permanently deforming or breaking.*

*45. The antenna according to claim 2, wherein said elongated conductor and said sleeve are configured to permit the antenna to be flexed in the extended position without permanently deforming or breaking.*

*46. The antenna according to claim 2, wherein said elongated conductor is substantially longer than said sleeve.*

*47. The antenna according to claim 2, the elongated conductor forming the primary length of the antenna.*

*48. The antenna according to claim 8, wherein the elongated conductor is flexible when in the extended position.*

*49. The antenna according to claim 8, being flexible in the extended position.*

*50. The antenna according to claim 49, wherein said sleeve has a length such that it only partially extends from the housing in the extended position.*

*51. The antenna according to claim 8, wherein said sleeve has a length such that it only partially extends from the housing in the extended position.*

*52. The antenna according to claim 51, wherein said elongated conductor and said sleeve are configured to permit the antenna to be flexed in the extended position without permanently deforming or breaking.*

*53. The antenna according to claim 8, wherein said elongated conductor and said sleeve are configured to permit the antenna to be flexed in the extended position without permanently deforming or breaking.*

*54. The antenna according to claim 8, wherein said elongated conductor is substantially longer than said sleeve.*

*55. The antenna according to claim 8, the elongated conductor forming the primary length of the antenna.*

*56. The antenna according to claim 8, wherein said sleeve is disposed surrounding a lower end of said elongated conductor and has a length that encompasses only the lower end of said elongated conductor in said retracted position.*

*57. The antenna according to claim 8, wherein each of said plural legs includes a bulbous portion for contacting said inner portion of said sleeve.*

*58. The antenna according to claim 1, wherein said elongated conductor is substantially longer than said sleeve.*

*59. The antenna according to claim 1, the elongated conductor forming the primary length of the antenna.*

*60. The antenna according to claim 1, wherein said sleeve is disposed surrounding a lower end of said elongated conductor and has a length that encompasses only the lower end of said elongated conductor in said retracted position.*

*61. The antenna according to claim 17, wherein each of said plural legs includes a bulbous portion for contacting said inner portion of said sleeve.*

*62. The antenna according to claim 33, wherein each of said plural legs includes a bulbous portion for contacting said inner portion of said sleeve.*

*63. A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*wherein said portion of said elongated conductor is a lower portion of said elongated conductor and said elongated conductor is flexible when in the extended position.*

*64. A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*wherein said enlarged spring contact includes a plurality of legs separated from each other having a natural distance of separation greater than that permitted by the inner surface of said sleeve;*

*wherein said portion of said elongated conductor is a lower portion of said elongated conductor, the antenna being flexible in the extended position.*

*65. The antenna according to claim 64, wherein said sleeve has a length such that it only partially extends from the housing in the extended position.*

*66. A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*wherein said portion of said elongated conductor is a lower portion of said elongated conductor and said sleeve has a length such that it only partially extends from the housing in the extended position.*

*67. The antenna according to claim 66, wherein said elongated conductor and said sleeve are configured to permit the antenna to be flexed in the extended position without permanently deforming or breaking.*

*68. A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continu-*

*ous electrical contact between said sleeve and said elongated conductor while allowing relative movement between said sleeve and said elongated conductor;*

*wherein said enlarged spring contact includes a plurality of legs separated from each other having a natural distance of separation greater than that permitted by the inner surface of said sleeve;*

*wherein said portion of said elongated conductor is a lower portion of said elongated conductor and said elongated conductor and said sleeve are configured to permit the antenna to be flexed in the extended position without permanently deforming or breaking.*

*69. A retractable antenna for a portable communicator having an antenna mount with a hole, the antenna comprising:*

*an elongated conductor sized to pass throught the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*wherein said portion of said elongated conductor is a lower portion and said elongated conductor is substantially longer than said sleeve.*

*70. A retractable antenna for a portable communicator having an antenna mount with a hole, the antenna comprising:*

*an elongated conductor sized to pass through the hole;*

*an electrical contact sleeve disposed around at least a portion of said elongated conductor; and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*wherein said enlarged spring contact includes a plurality of legs separated from each other having a natural distance of separation greater than that permitted by the inner surface of said sleeve;*

*wherein said portion of said elongated conductor is a lower portion, the elongated conductor forming the primary length of the antenna.*

*71. A retractable antenna for a portable communicator having an antenna mount with a hole, the antenna conprising:*

*an elongated conductor sized to pass through the hole;*

*an electrical contact sleeve disposed around at least a portion of said elongated conductor: and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*wherein said sleeve is disposed surrounding a lower end of said elongated conductor and has a length that encompasses only the lower end of said elongated conductor in said retracted position.*

*72. A retractable antenna for a portable communicator having an antenna mount with a hole, the antenna comprising:*

*an elongated conductor sized to pass through the hole;*

*an electrical contact sleeve disposed around at least a portion of said elongated conductor: and*

*an enlarged spring contact disposed on a portion of said elongated conductor, and which exerts a spring force on an inner surface of said sleeve to maintain continuous electrical contact between said sleeve and said elongated conductor while allowing relative movement between said sleeve and said elongated conductor;*

*wherein said enlarged spring contact includes a plurality of legs separated from each other having a natural distance of separation greater than that permitted by the inner surface of said sleeve;*

*wherein said sleeve is disposed surrounding a lower end of said elongated conductor and has a length that encompasses only the lower end of said elongated conductor in said retracted position.*

* * * * *